US010207273B2

(12) United States Patent
Kamees

(10) Patent No.: US 10,207,273 B2
(45) Date of Patent: Feb. 19, 2019

(54) TEST TUBE HOLDING ASSEMBLY

(71) Applicant: Heathrow Scientific LLC, Vernon Hills, IL (US)

(72) Inventor: Gary Dean Kamees, Gurnee, IL (US)

(73) Assignee: HEATHROW SCIENTIFIC LLC, Vernon Hills, IL (US)

( * ) Notice: Subject to any disclaimer, the term of this patent is extended or adjusted under 35 U.S.C. 154(b) by 66 days.

(21) Appl. No.: 15/163,532

(22) Filed: May 24, 2016

(65) Prior Publication Data

US 2017/0341080 A1 Nov. 30, 2017

(51) Int. Cl.
*B01L 9/06* (2006.01)

(52) U.S. Cl.
CPC ..... *B01L 9/06* (2013.01); *B01L 2200/023* (2013.01); *B01L 2200/028* (2013.01); *B01L 2300/0832* (2013.01); *B01L 2300/0848* (2013.01)

(58) Field of Classification Search
None
See application file for complete search history.

(56) References Cited

U.S. PATENT DOCUMENTS

| | | | |
|---|---|---|---|
| 1,980,930 | A | 11/1934 | Reyniers |
| 2,189,989 | A | 2/1940 | Lichtman |
| 3,379,315 | A | 4/1968 | Broadwin |
| 3,625,485 | A | 12/1971 | Adler |
| 3,744,665 | A | 7/1973 | Spoto |
| 3,918,920 | A | 11/1975 | Barber |
| 4,135,660 | A | 1/1979 | Conn et al. |
| 4,482,522 | A | 11/1984 | Baudisch et al. |
| 4,938,369 | A | 7/1990 | Carilli |
| 4,944,924 | A | 7/1990 | Mawhirt et al. |
| 5,036,989 | A | 8/1991 | Carilli |
| 5,137,693 | A | 8/1992 | Mawhirt |
| 5,285,907 | A | 2/1994 | Franchere et al. |
| 5,378,433 | A | 1/1995 | Duckett et al. |

(Continued)

FOREIGN PATENT DOCUMENTS

| | | |
|---|---|---|
| EP | 0414644 | 2/1991 |
| EP | 0469390 | 2/1992 |

(Continued)

OTHER PUBLICATIONS

Daiger 1996 Catalog, "Nalgene Unwire Test Tube Wires, 50ml Centrifuge Tube Rack, Epoxy Coated Wire Test Tube Racks, Nalgene Microcentrifuge Tube Racks, Nalgene Floating Microtube Racks, Radioimmunoassay Tube Racks, Stack Rack Test Tube Racks" pp. 298-300.

(Continued)

*Primary Examiner* — Paul S Hyun
(74) *Attorney, Agent, or Firm* — Michael Best & Friedrich LLP

(57) ABSTRACT

A test tube holding assembly or test tube rack includes at least two test tube holders, where each test tube holder in turn defines a central longitudinal axis, two storage zones, and includes a connecting member. The connecting members permit coupling of the two test tube holders and rotation of the two coupled test tube holders about an axis parallel to the longitudinal axis of at least one of the test tube holders. The test tube holders are also positionable in multiple orientations, where each orientation at least partially determines which of the two storage zones are available to receive a test tube therein.

12 Claims, 5 Drawing Sheets

(56) References Cited

U.S. PATENT DOCUMENTS

| | | | |
|---|---|---|---|
| 5,985,219 | A | 11/1999 | Lind |
| 6,083,462 | A | 7/2000 | Ikonen et al. |
| 6,543,100 | B1 | 4/2003 | Finley et al. |
| 6,640,981 | B2 | 11/2003 | Lafond et al. |
| 7,000,785 | B2 | 2/2006 | Jafari et al. |
| 8,367,024 | B2 | 2/2013 | Hoh |
| 2002/0108917 | A1 | 8/2002 | Maruyama |
| 2003/0215370 | A1 | 11/2003 | Hoh |
| 2005/0180895 | A1 | 8/2005 | Hoh |
| 2007/0163973 | A1 | 7/2007 | Smokowicz et al. |
| 2010/0089850 | A1 | 4/2010 | Hovatter |
| 2014/0118733 | A1 | 5/2014 | Harward |
| 2015/0101911 | A1 | 4/2015 | Friedman |

FOREIGN PATENT DOCUMENTS

| | | |
|---|---|---|
| EP | 0579486 | 1/1994 |
| GB | 1062894 | 3/1967 |
| JP | 2010078483 | 4/2010 |
| JP | 2010201396 | 9/2010 |

OTHER PUBLICATIONS

Heathrow Scientific 1999 Catalog, "Interlocking Racks: Cube Rack, Interlocking Racks: 20-Well Tube Racks, Interlocking Racks: 4-Way Microtube Racks, Tube Racks: 50-0Well or 100-Well EPS Tube Racks, Tube Racks: 80-Well Microtube Racks, Economy Test Tube Racks" pp. 2, 4.

Daiger 1999-2000 Catalog, "81-Well Freezer Storage Racks, Soft Foam Tube Racks, Micro-sample Test Tube Rack, Nalgene Polycarbonate Test Tube Racks, Snap Together Racks," pp. 491, 493, 495.

Daigger 2000 Catalog, "Tube Racks, 50-mL Single Tube Holder, No-Wire Microtube Racks, 80-Well Microtube Rack," pp. 523, 526 and 527.

Daigger Life Science Edition 2001 Catalog, "Thermal Cycler Tube Racks," 2 pages.

Daigger 2002-2003 Catalog, "Nova Rack, Nalgene Unwire Test Tube Retainers, Nalgene Stackable Test Tube Racks, Slant Tube Racks, Economy Culture Tube Racks, Test Tubes with Drying Pegs, Stainless Steel "Z" Racks, 50-mL Single Tube Holder, 96-Well Reversible Racks, Microtube Racks, 3-Way Racks," pp. 652-658.

Daigger 2003 Catalog, "1-Well Racks, 15- and 30-mL Tube Wire Racks, Snap-Together Conical Tube Racks, Economy Test Tube Racks, Adjustable-Shelf Test Tube Rack, Certifuge Bottle Rack," 4 pages.

Daigger 2004-2005 Catalog, "Snap-Together Test Tube Racks, Economy Test Tube Racks," p. 80.

Daigger 2006 Catalog, "Arctic Squares Cryostorage Boxes, Locking Microtube Storage Boxes, OneRack Test Tube Racks," 4 pages.

EP16275154.9 Extended European Search Report dated Oct. 18, 2017 (7 pages).

Examination Report from the European Patent Office for related Application No. 16275154.9 dated Oct. 24, 2018 (4 pages).

TEST TUBE HOLDING ASSEMBLY

BACKGROUND

The present disclosure relates to a test tube holding assembly, which are sometimes referred to as a test tube rack, and more specifically to a test tube holding assembly configured to store different combinations of test tubes of various sizes. The test tube holding assembly is also configured to change shape, allowing it to store test tubes in different positions with respect to one another.

In laboratory settings, product flexibility is important to accommodate the various requirements of different experiments. Specifically, the ability to place items, such as test tubes, in readily accessible positions on the work surface can aid the scientist or technician in conducting an experiment. Furthermore, the ability to adjust the shape of the test tube holding assembly on the work surface is useful in instances where different experiments are conducted. Still further, the ability of a test tube holder to accommodate different combinations of test tube sizes permits a single rack to accommodate different experiments.

SUMMARY

In one aspect, a test tube holding assembly including a first test tube holder having a first connecting member, the first test tube holder defining a first storage zone and a second storage zone, the first test tube holder being adjustable between a first orientation where the first storage zone of the first test tube holder is accessible and the second storage zone of the first test tube holder is inaccessible, and a second orientation where the first storage zone of the first test tube holder is inaccessible and the second storage zone of the first test tube holder is accessible. The test tube holding assembly also includes a second test tube holder having a second connecting member couplable to the first connecting member, the second test tube holder defining a first storage zone and a second storage zone, the second test tube holder being adjustable between a first orientation where the first storage zone of the second test tube holder is accessible and the second storage zone of the second test tube holder is inaccessible, and a second orientation where the first storage zone of the second test tube holder is inaccessible and the second storage zone of the second test tube holder is accessible, and where the first test tube holder is couplable to the second test tube holder when either test tube holder is in either orientation.

In another aspect, a test tube holding assembly including a test tube holder having a first end, a second end opposite the first end, and defining a longitudinal axis therethrough, where the first test tube holder includes a first support ring positioned proximate a first end, a second support ring positioned proximate a second end, and a stop ring positioned axially between the first support ring and the second support ring.

In still another aspect, a test tube holding assembly including a first test tube holder having a first end, a second end opposite the first end, and a first connecting member, the first test tube holder defining a first storage zone configured to receive a test tube via the first end of the first test tube holder, and a second storage zone configured to receive a test tube via the second end of the first test tube holder. The test tube holding assembly also including a second test tube holder having a first end, a second end opposite the first end, and a second connecting member removably couplable to and pivotable with respect to the first connecting member, the second test tube holder defining a first storage zone configured to receive a test tube via the first end of the second test tube holder, and a second storage zone configured to receive a test tube via the second end of the second test tube holder; and where the first test tube holder is couplable to the second test tube holder so that any two of the storage zones may receive a test tube regardless of which ends of the test tube holders rest upon a support surface.

In still another aspect, a test tube holding assembly including at least two test tube holders, each test tube holder defining a central longitudinal axis, two storage zones, and having a connecting member, where the connecting members permit coupling of the two test tube holders and rotation of the two coupled test tube holders about an axis parallel to the longitudinal axis of at least one of the test tube holders.

In still another aspect, a test tube holder including a plurality of longitudinally extending ribs of equal length, a first support ring joining the ribs proximate a longitudinal first end, a second support ring joining the ribs proximate a second longitudinal end opposite the first longitudinal end, and a stop ring joined to the ribs and positioned between the first and second ends.

Other aspects of the disclosure will become apparent by consideration of the detailed description and accompanying drawings.

DETAILED DESCRIPTION

Figure 1:
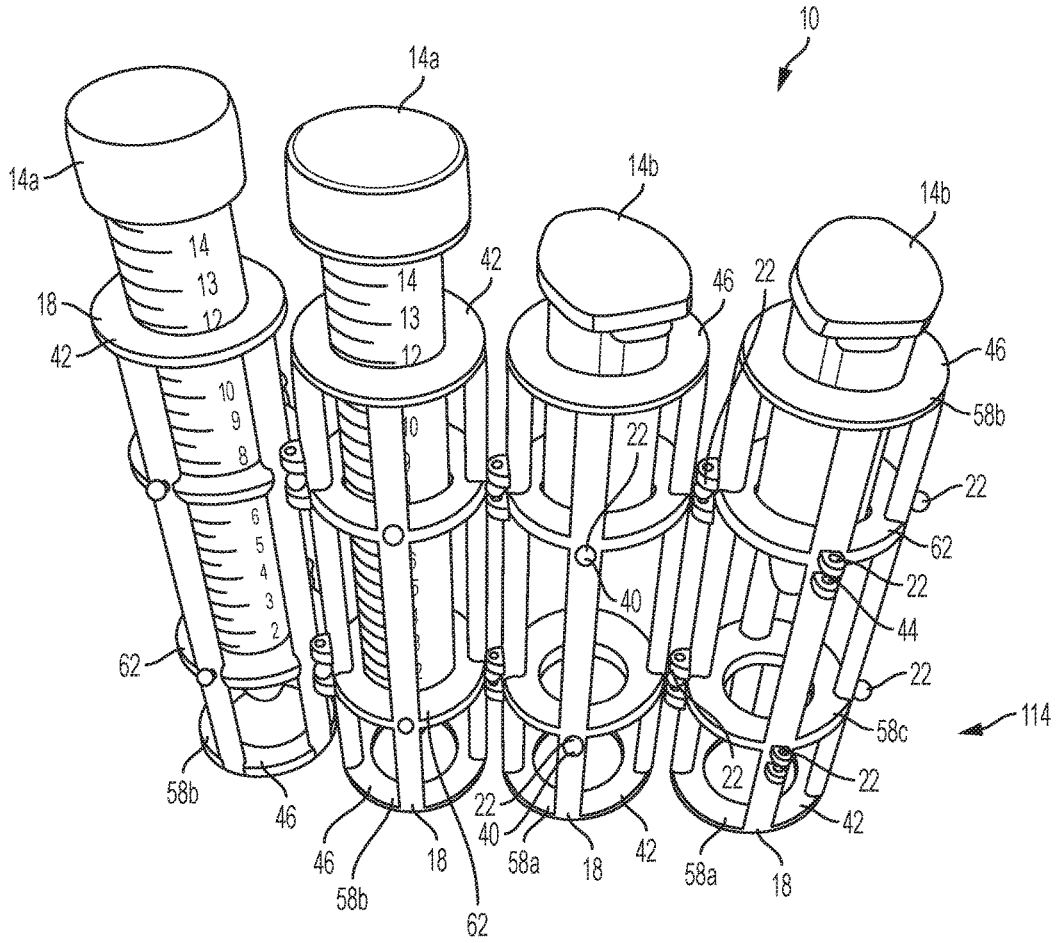
FIG. 1 is a perspective view of a test tube holding assembly in a linear orientation.

Before any constructions of the disclosure are explained in detail, it is to be understood that the disclosure is not limited in its application to the details or arrangement of components set forth in the following description or illustrated in the accompanying drawings. The disclosure is capable of supporting other implementations and of being practiced or of being carried out in various ways.

FIGS. 1-5 generally illustrate a test tube holding assembly 10 configured to store various combinations of different sized test tubes in a variety of positions. In particular, the test tube holding assembly 10 is formed from a plurality of individual test tube holders 18 each releasably and pivotably coupled to one another by a series of connecting members 22. The connecting members 22 in turn permit the user to adjust the relative positions of the test tube holders 18 with respect to one another while also permitting each test tube holder 18 to be placed in a plurality of different orientations. The orientation of the test tube holder 18 in turn determines which size of test tube 14*a*, 14*b* may be stored within test tube holder 18 (described below).

Illustrated in FIGS. 1-5, each test tube holder 18 of the test tube holding assembly 10 includes a body 26, and one or more connecting members 22 coupled to and extending radially outwardly from the body 26. The body 26 of the each test tube holder 18 in turn defines a plurality of storage zones 38*a*, 38*b*, (FIG. 3), each of which is configured to receive and store a respective test tube 14 therein. During use, the orientation of each test tube holder 18 (as described below) at least partially determines the availability of each storage zone 38*a*, 38*b*. For the purposes of this application, a storage zone 38*a*, 38*b* is considered "available" or "accessible" if it is able to receive a test tube therein without further manipulation of the corresponding test tube holder 18; in contrast, a storage zone 38*a*, 38*b* is considered "unavailable" or "inaccessible" if it is unable to receive a test tube therein without further manipulation of the corresponding test tube holder 18.

Figure 2:
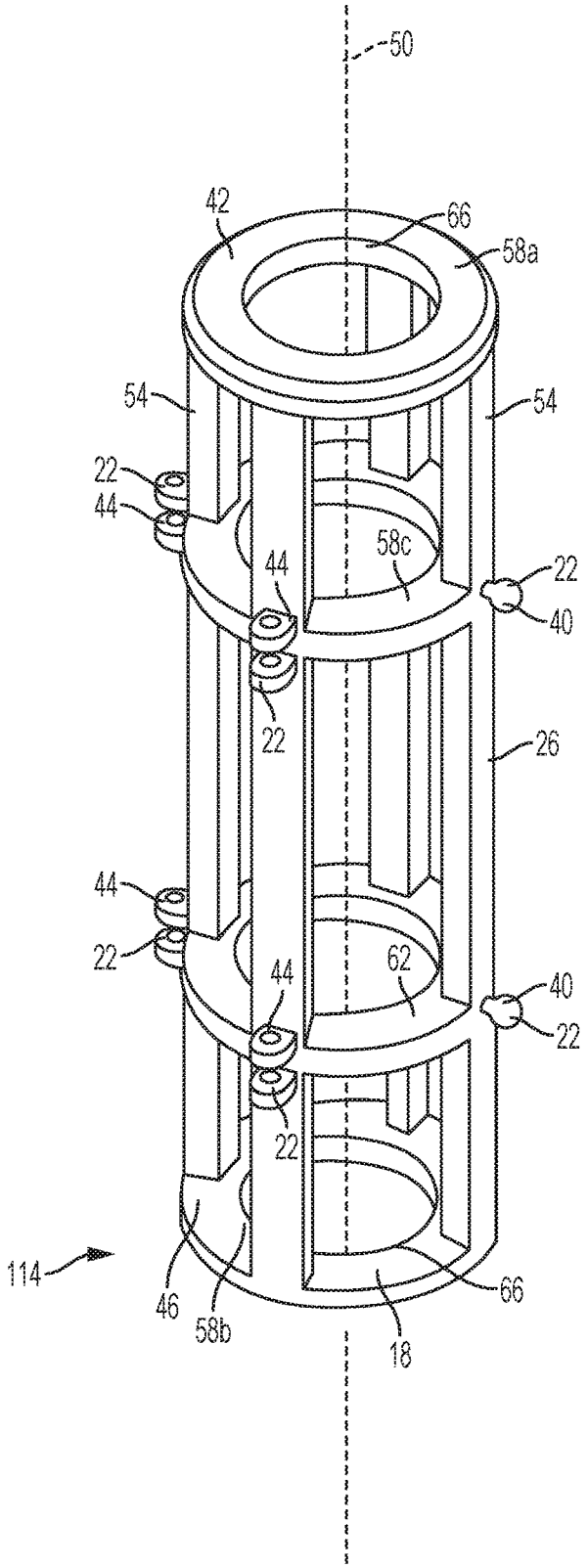
FIG. 2 is a perspective view of a test tube holder of the test tube holding assembly of FIG. 1.
Figure 3:
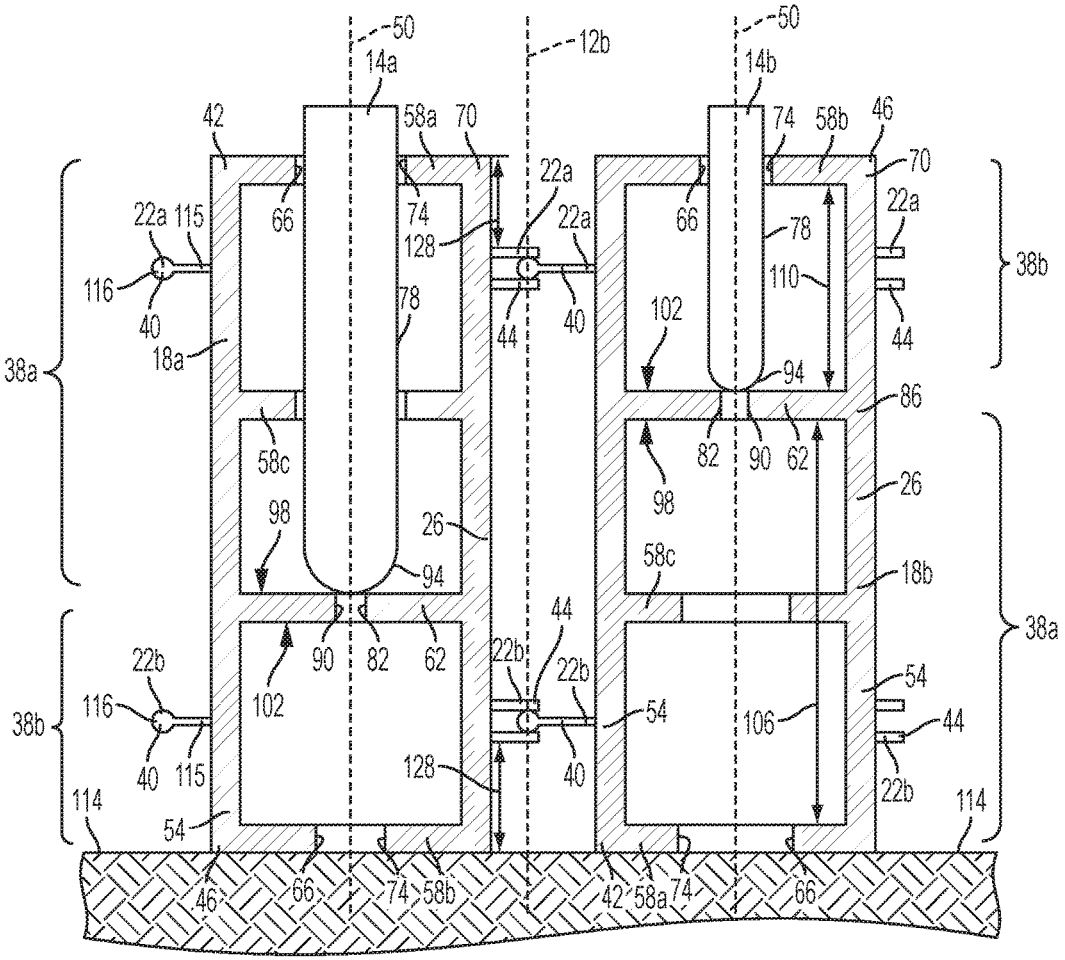
FIG. 3 is a section view two test tube holders of the test tube holding assembly of FIG. 1 coupled together.

Illustrated in FIGS. 2 and 3, the body 26 of the test tube holder 18 outlines a substantially cylindrical shape having a first end 42, a second end 46 opposite the first end 42, and defining a central longitudinal axis 50 therethrough. The body 26 of each test tube holder 18 includes a set of circumferentially spaced ribs 54 extending the axial length of the body 26, a first support ring 58*a* positioned proximate the first end 42, a second support ring 58*b* positioned proximate the second end 46, and a stop ring 62 positioned axially between the first support ring 58*a* and the second support ring 58*b*. The rings 58*a*, 58*b*, and 62 of the body 26 generally define the first storage zone 38*a* between the first support ring 58*a* and the stop ring 62, and the second storage zone 38*b* between the second support ring 58*b* and the stop ring 62. The body 26 may also include one or more secondary support rings 58*c* to provide additional support for the test tube 14 and structural integrity to the body 26. In the illustrated construction, the ribs 54, support rings 58, and stop rings 62 are all formed from a single piece of material. However, in alternative constructions, each element may be formed separately and coupled together.

The support rings 58 of the body 26 are substantially annular in shape, each defining a central aperture 66 therethrough. Each support ring 58 defines an outer diameter 70 that substantially corresponds with the outer diameter of the body 26, and a smaller inner diameter 74 that substantially corresponds with, but larger than, the outer diameter 78 of the test tube 14 the support ring 58 is intended to support. Stated differently, the central apertures 66 of the support rings 58 are sized to permit the test tube 14 to pass therethrough while providing radial support and maintaining the test tube in a generally vertical orientation. Dependent upon the size of the test tube 14 that a particular support ring 58 is intended to receive, the inner diameter 74 of each support ring 58 may differ from those of other support rings 58 in a particular test tube holder 18. In the illustrated construction, the first support ring 58*a* includes an inner diameter that is larger than the inner diameter of the second support ring 58*b*; however in alternative constructions, both inner diameters may be the same.

The stop rings 62 of the body 26 are also substantially annular in shape, each defining a central aperture 82 therethrough. The stop rings 62 define an outer diameter 86 substantially corresponding to the outer diameter of the body 26, and an inner diameter 90 that is smaller than the outer diameter of the test tube(s) 14 it is intended to support. More specifically, the stop rings 62 of the body 26 are configured to contact and support the bottom end 94 of a test tube 14 without permitting the test tube 14 to pass therethrough, so that the test tube can rest upon the stop ring. In the illustrated construction, the stop ring 62 of the body 26 provides support for both the first storage zone 38*a* (i.e., when the bottom end 94 of a test tube 14 contacts a first side 98 of the stop ring 62) and the second storage zone 38*b* (i.e., when the bottom end 94 of a test tube 14 contacts a second side 102 of the stop ring 62). However in alternative constructions, multiple stop rings 62 (not shown) may be present, allowing each stop ring 62 to provide support for a particular storage zone.

In the illustrated construction, the stop ring 62 is annular in shape; however in alternative constructions, the stop ring 62 may include any shape or contour that supports the bottom end 94 of a test tube 14 while not permitting the test tube 14 to pass therethrough. In some constructions, the stop ring 62 may be disk shaped, without a central aperture, providing two opposing substantially planar surfaces that the test tube 14 may contact. In other constructions, each stop ring 62 may form a depression or cup (not shown) shaped to receive the bottom end 94 of the test tube 14 therein.

In the illustrated construction, the stop ring 62 is positioned a first distance 106 from the first support ring 58*a* and a second distance 110, less than the first distance 106, from the second support ring 58*b*. The relative position of the rings 58*a*, 58*b*, 62 causes the first storage zone 38*a* to be axially longer than the second storage zone 38*b* (FIG. 3). As such, the first storage zone 38*a* is able to accommodate longer test tubes 14*a* than the second storage zone 38*b*. In alternative constructions, the stop ring 62 may be positioned at the axial center of the body 26, allowing the first and second storage zones 38*a*, 38*b* to have similar axial depths. In other constructions, the stop ring 62 may be adjustable axially with respect to the body 26, allowing the user to manually set the first distance 106 and the second distance 110 to accommodate test tubes of different lengths. In still other constructions, the body 26 may include additional stop rings 62 (not shown) so that the first distance 106 and the second distance 110 may be adjusted or set independently of one another.

During use, the body 26 of the test tube holder 18 is configured such that the "orientation" of the test tube holder 18 at least partially determines which storage zone 38*a*, 38*b* is accessible by the user at any one time. For example, when the test tube holder 18 is in a first orientation (see test tube holder 18*a* of FIG. 3), the first storage zone 38*a* is able to receive and store a test tube 14*a* via the first end 42 of the body 26 while the second storage zone 38*b* is inaccessible. Furthermore, the first storage zone 38*a* is positioned vertically above the second storage zone 38*b* in the first orientation. In contrast, when the test tube holder 18 is in a second orientation (see test tube holder 18*b* of FIG. 3), the second storage zone 38*b* is able to receive and store a test tube via the second end 46 of the body 26 while the first storage zone 38*a* is inaccessible. Furthermore, the second storage zone 38*b* is positioned vertically above the first storage zone 38*a*. For the purposes of this application, the "orientation" of a test tube holder 18 is defined as the position of the body 26 with respect to vertical and is generally dictated by which end 42, 46 of the test tube holder 18 is in contact with or resting on a table, desk or other support surface 114. In the illustrated construction, the test tube holder 18 is in the first orientation when the second end 46 of the body 26 is in contact with the support surface 114 (see test tube holder 18*a* of FIG. 3), and the test tube holder 18 is in the second orientation when the first end 42 of the body 26 is in contact with the support surface 114 (see test tube holder 18*b* of FIG. 3).

In the illustrated construction, the test tube holder 18 defines two storage zones 38*a*, 38*b*, each of which are sized to receive a single test tube 14 therein. However, in alternative constructions, the test tube holder 18 may include more than two storage zones or each zone may be capable of receiving multiple test tubes therein (e.g., the first storage zone is configured to receive two test tubes while the second and third storage zones are configured to receive three test tubes).

Illustrated in FIGS. 1-5, each test tube holder 18 includes one or more connecting members 22 each coupled to the body 26 of a respective test tube holder 18 and configured to be releasably and pivotably coupled to a corresponding connecting member 22 of a different test tube holder. Furthermore, the connecting members 22 are configured such that the test tube holders 18 may be coupled to one another regardless of their relative orientation while still maintaining the pivoting capability. For example, a test tube holder 18 in the first orientation may be coupled to other test tube holders in both the first orientation and the second orientation (see FIG. 1). Similarly, a test tube holder 18 in the second orientation may be coupled to other test tube holders in both the first orientation and the second orientation (see FIG. 1).

Figure 4:
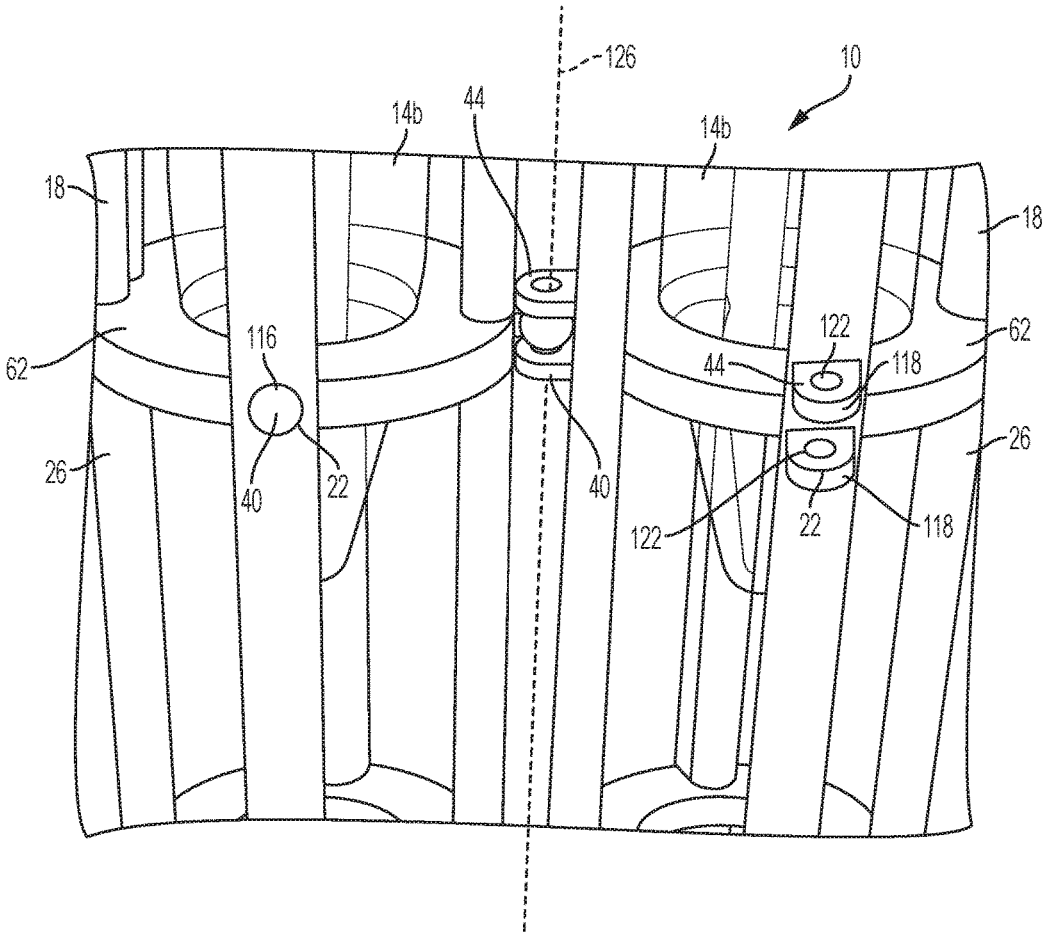
FIG. 4 is a detailed view of the connecting members of the test tube holding assembly of FIG. 1.

Best illustrated in FIG. 4, the connecting members 22 of the test tube holders 18 are formed of two types: male connecting members 40, and female connecting members 44. During use, the male and female connecting members 40, 44 are configured such that each male connecting member 40 of one test tube holder 18 may be releasably and pivotably coupled to the corresponding female connecting members 44 of a second test tube holder 18. As such, the user is able to adjust the relative positions of adjacent test tube holders by pivoting the body 26 of each holder with respect to one another.

Illustrated in FIG. 4, each male connecting member 40 of the test tube holding assembly 10 includes a cylindrical member 115 extending radially outwardly from the body 26 of a respective test tube holder 18 to form a substantially spherical tip 116 (FIG. 3). More specifically, the tip 116 of the male connecting member 40 is sized and shaped to be at least partially received and retained within a corresponding female connecting member 44 of another test tube holder 18 and pivot with respect thereto. While the male connecting member 40 of the present invention is substantially spherical in shape, in alternative constructions other shapes may be utilized so long as they permit the male connecting member 40 to be both coupled to corresponding female connecting members 44 and pivot within a female member 44.

Illustrated in FIG. 4, each female connecting member 44 of the test tube holding assembly 10 includes a pair of protrusions 118, each extending radially from the body 26 of a respective test tube holder 18 and spaced axially from one another. The protrusions 118 are configured to receive and retain at least a portion of the male connecting member 40 therebetween. In the illustrated construction, the protrusions 118 are spaced an axial distance from one another that is slightly less than the axial width or diameter of the tip 116 of the male connecting member 40 such that the male connecting member 40 is captured between the protrusions 118 and requires a pre-determined level of force to remove it therefrom (e.g., a release force). Illustrated in FIG. 4, the protrusions 118 also each define a recess 122 to better contour to the outer surface of the tip 116 and increase the retention strength of the female connecting member 44.

In the illustrated construction, each test tube holder 18 includes four pairs of connecting members 22, each pair consisting of two axially aligned male connecting members 40 or two axially aligned female connecting members 44 (see FIG. 2). Each pair, in turn, is spaced evenly about the outer circumference of the body 26 approximately 90 degrees apart. In alternative constructions, each test tube holder 18 may include more or fewer pairs of connecting members 22. Furthermore, alternative test tube holders 18 may include different combinations of male and female pairs.

Illustrated in FIG. 2 and, each pair of connecting members are axially aligned, forming a sub-axis 126 that is substantially parallel to the longitudinal axis 50 of the body 26. Furthermore, each individual connecting member 22 of each pair is positioned an equal axial distance from the corresponding end 42, 46 of the body 26. For example, for each pair, one connecting member 22*a* is positioned a first distance 128 from the first end 42, while the second connecting member 22*b* of that same pair is positioned the same first distance 128 from the second end 46.

To assemble and use the test tube holding assembly 10, the user collects the desired number of test tube holders 18. The user then orients each individual test tube holder 18 in either the first orientation or the second orientation dependent upon whether the user wishes to utilized the first storage zone 38*a* or the second storage zone 38*b*. For example, if the user wishes to store two small test tubes 14*b* and two large test tubes 14*a*, the user will collect four test tube holders 18, placing two in the second orientation and two in the first orientation (see FIG. 1).

Figure 5:
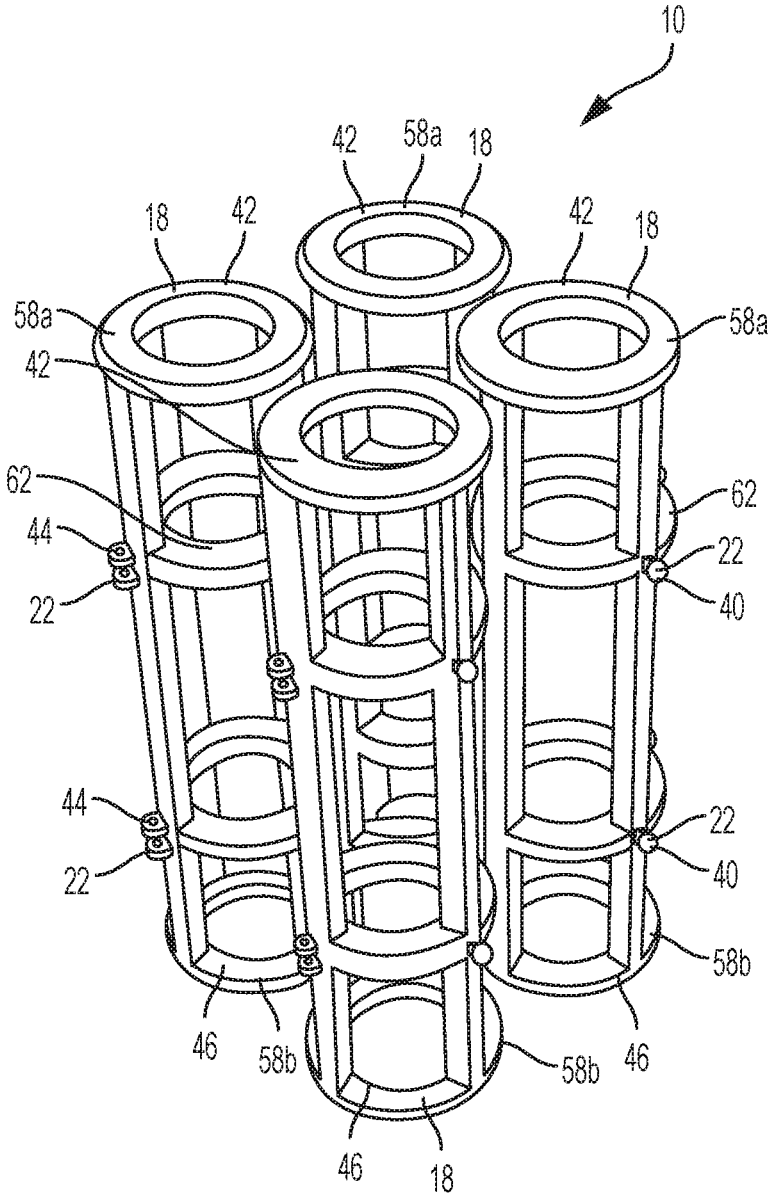
FIG. 5 is a perspective view of the test tube holding assembly of FIG. 1 in a rectangular orientation.

With the test tube holders 18 collected and oriented, the user may then couple the test tube holders 18 to one another by inserting the male connecting members 40 of select test tube holders 18 into the desired axially corresponding female connecting members 44 of other test tube holders. Depending upon the requirements of the particular experiment or test being conducted, the user may position the test tube holders 18 in any number of orientations. For example, the user may create a long chain of test tube holders 18, whereby the user may adjust the contour of the chain by pivoting the test tube holders 18 with respect to one another about the axis of rotation 126 created by the connecting members 22 to create a slightly arcuate array (FIG. 1). In still other constructions, the user may create a grid of test tube holders 18 whereby each test tube holder 18 is coupled such that it creates a rectangular array (FIG. 5). In still other constructions, a different shaped arrays may be formed as desired.

Once the test tube holding assembly 10 is assembled, the user may then insert the test tubes 14*a*, 14*b* into their respective test tube holders 18. In particular, the user may insert all small test tubes 14*b* into test tube holders 18 in the second orientation and all large test tubes 14*a* in test tube holders 18 in the first orientation. To insert a test tube, the user aligns the bottom end 94 of the test tube 14 with the axis 50 of the body 26 and axially inserts the test tube into the body 26 allowing the test tube 14 to pass through the one or more support rings 58 until it contacts the stop ring 62. Once in place, the test tube holder 18 will hold the test tube 14 in a substantially upright and vertical position.

When the experiment is completed, the user may easily remove each of the test tubes 14 from their respective test tube holders 18 by reversing the insertion process. Furthermore, the user may detach each test tube holder 18 from one another by pulling radially apart with a force greater than the release force, causing the male connecting member 40 to separate from the female connecting member 44, separating the two test tube holders 18. The individual test tube holders 18 may then be stored for subsequent use.

What is claimed is:

1. A test tube holding assembly comprising:

a first test tube holder having a first connecting member, the first test tube holder defining a first storage zone and a second storage zone, the first test tube holder being adjustable between a first orientation where the first storage zone of the first test tube holder is accessible and the second storage zone of the first test tube holder is inaccessible, and a second orientation where the first storage zone of the first test tube holder is inaccessible and the second storage zone of the first test tube holder is accessible, and wherein the first test tube holder defines a first longitudinal axis extending through the first storage zone and the second storage zone of the first test tube holder;

a second test tube holder having a second connecting member couplable to the first connecting member, the second test tube holder defining a first storage zone and a second storage zone, the second test tube holder being adjustable between a first orientation where the first storage zone of the second test tube holder is accessible and the second storage zone of the second test tube holder is inaccessible, and a second orientation where the first storage zone of the second test tube holder is inaccessible and the second storage zone of the second test tube holder is accessible, and wherein the second test tube holder defines a second longitudinal axis extending through the first storage zone and the second storage zone of the second test tube holder; and wherein the first test tube holder is couplable to the second test tube holder when either test tube holder is in either orientation and wherein the first test tube holder is pivotable relative to the second test tube holder about a third axis that is substantially parallel to at least one of the first longitudinal axis and the second longitudinal axis.

2. The test tube holding assembly of claim 1, wherein the first connecting member includes a male connecting member.

3. The test tube holding assembly of claim 2, wherein the second connecting member includes a female connecting member.

4. The test tube holding assembly of claim 1, wherein the first test tube holder includes at least one support ring defining an aperture sized to permit a test tube to pass therethrough, and at least one stop ring defining an aperture sized to restrict the test tube from passing therethrough.

5. The test tube holding assembly of claim 1, wherein the first connecting member is pivotable with respect to the second connecting member.

6. The test tube holding assembly of claim 1, wherein the first storage zone of the first test tube holder is configured to receive a test tube of a first size, and wherein the second storage zone of the first test tube holder is configured to receive a test tube of a second size different than the first size.

7. The test tube holding assembly of claim 6, wherein the first storage zone of the second test tube holder is configured to receive a test tube of the first size.

8. The test tube holding assembly of claim 6, wherein the first storage zone of the second test tube holder is configured to receive a test tube of a third size, different from the first and second sizes.

9. The test tube holding assembly of claim 1, wherein the first storage zone of the first test tube holder is identical in size to the first storage zone of the second test tube holder, and wherein the second storage zone of the first test tube holder is identical in size to the second storage zone of the second test tube holder.

10. The test tube holding assembly of claim 1, wherein when the first test tube holder is in the first orientation, the first storage zone of the first test tube holder is positioned vertically above the second storage zone of the first test tube holder, and when the first test tube holder is in the second orientation, the second storage zone of the first test tube holder is positioned vertically above the first storage zone of the first test tube holder.

11. A test tube holding assembly comprising:

a first test tube holder having a first end, a second end opposite the first end, and a first connecting member, the first test tube holder defining a first storage zone configured to receive a test tube via the first end of the first test tube holder, and a second storage zone configured to receive a test tube via the second end of the first test tube holder, wherein the first test tube holder defines a first longitudinal axis extending through the first storage zone and the second storage zone of the first test tube holder;

a second test tube holder having a first end, a second end opposite the first end, and a second connecting member removably couplable to and pivotable with respect to the first connecting member, the second test tube holder defining a first storage zone configured to receive a test tube via the first end of the second test tube holder, and a second storage zone configured to receive a test tube via the second end of the second test tube holder, wherein the second test tube holder defines a second longitudinal axis extending through the first storage zone and the second storage zone of the second test tube holder; and wherein the first test tube holder is couplable to the second test tube holder so that any two of the storage zones may receive a test tube regardless of which ends of the test tube holders rest upon a support surface, wherein the first test tube holder is pivotable relative to the second test tube holder about a third axis, and wherein the third axis is positioned between the first axis and the second axis.

12. The test tube holding assembly of claim 11, wherein the first storage zone of the first test tube holder is accessible when the first test tube holder is in a first orientation, and wherein the second storage zone of the first test tube holder is accessible when the test tube holder is in a second orientation.

* * * * *